US005977021A

United States Patent [19]

Aoyama et al.

[11] Patent Number: 5,977,021

[45] Date of Patent: Nov. 2, 1999

[54] HEAT-SENSITIVE RECORDING ADHESIVE SHEET

[75] Inventors: Shigeo Aoyama, Toyonaka; Ritsuo Mando, Sakai, both of Japan

[73] Assignee: OJI Paper Co., Ltd, Tokyo-To, Japan

[21] Appl. No.: 08/988,218

[22] Filed: Dec. 10, 1997

[30] Foreign Application Priority Data

| | | | |
|---|---|---|---|
| Dec. 24, 1996 | [JP] | Japan | 8-343572 |
| Jan. 13, 1997 | [JP] | Japan | 9-003422 |
| May 22, 1997 | [JP] | Japan | 9-132023 |

[51] Int. Cl.[6] ..... B41M 5/40

[52] U.S. Cl. ..... 503/226; 503/200; 503/216

[58] Field of Search ..... 428/195, 343, 428/352, 353, 354; 503/200, 216; 427/152

[56] References Cited

U.S. PATENT DOCUMENTS

| | | | |
|---|---|---|---|
| 4,851,383 | 7/1989 | Fickenscher et al. | 503/200 |
| 5,508,247 | 4/1996 | Tran et al. | 503/200 |

FOREIGN PATENT DOCUMENTS

| | | |
|---|---|---|
| 0 600 622 A1 | 6/1994 | European Pat. Off. . |
| 60-54842 | 3/1985 | Japan . |
| 2-165989 | 6/1990 | Japan . |
| 3-169585 | 7/1991 | Japan . |
| 5-008541 | 1/1993 | Japan . |
| 6-222717 | 8/1994 | Japan . |

*Primary Examiner*—Bruce H. Hess
*Attorney, Agent, or Firm*—Kubovcik & Kubovcik

[57] ABSTRACT

The present invention relates to a liner free heat-sensitive recording adhesive sheet comprising a substrate, a heat-sensitive recording layer formed on one face of the substrate, a barrier layer formed on the heat-sensitive recording layer, a release layer formed on the barrier layer, and an adhesive layer formed on the other face of the substrate, wherein the barrier layer is formed by applying a coating composition comprising colloidal silica and at least one member selected from the group consisting of water-soluble resins and water-dispersible resins. The liner free heat-sensitive recording adhesive sheet is excellent in recording sensitivity and printer runability as well as cohesion between the barrier layer and the release layer.

19 Claims, 1 Drawing Sheet

HEAT-SENSITIVE RECORDING ADHESIVE SHEET

FIELD OF THE INVENTION

The present invention relates to a liner free heat-sensitive recording adhesive sheet.

PRIOR ART

Heat-sensitive recording materials are well known in which record images are formed by causing plural color producing agents to contact one another by heat. Since such heat-sensitive recording materials are relatively inexpensive and record images are formed thereon with use of a compact recording device with easy maintenance, the heat-sensitive recording materials are widely used as recording media for facsimile machines and various computers and also have wide applications in other fields.

As one of the applications, a heat-sensitive recording adhesive sheet used, for example, for the POS (point of sales) system is mentioned. In the conventional system in which adhesive labels are issued by recording devices, it was sufficient for the system to give such an adhesive label issuing rate that does not retard the manual label affixing procedure. However, with the recent spread of automatically operated labeling machines which are used in combination with a conveyor-belt, it has been demanded to produce adhesive labels at a higher speed. The adhesive label issuing rate is recently becoming faster owing to the development of information processing techniques and improvement in the performance of recording devices. Generally, however, the number of the adhesive labels that can be issued from one roll of the heat-sensitive adhesive sheet is limited, because the heat-sensitive recording adhesive sheet has a release liner superimposed on the rear surface of the sheet so as to protect the adhesive layer, leading to an increase in the diameter of a roll of the sheet, whereas the size of the roll to be placed in the recording machine is limited, with the result that with an increase in the recording rate, roll of the adhesive sheet must be fed to the recording device frequently. Further, in this case, there is another problem associated with disposing the release liner. Moreover, the proportion of the cost of the release liner relative to the total cost of the heat-sensitive adhesive sheet is not small.

Accordingly, there is a strong demand for a liner free heat-sensitive recording adhesive sheet, which does not pose problems even when used in the distribution control, which is suited for a high-speed issue of adhesive labels, and which is advantageous in coping with the environmental problems and in terms of the production cost.

Liner free heat-sensitive recording adhesive sheets are proposed in Japanese Unexamined Patent Publication No. 54842/1985, Japanese Unexamined Patent Publication No. 165989/1990, Japanese Unexamined Patent Publication No. 8541/1993 and Japanese Unexamined Patent Publication No. 222717/1994.

Recently, however, there are increasing occasions in which liner free heat-sensitive recording adhesive sheets are used for distribution control purposes, e.g., as adhesive sheets used for shipping or as airplane baggage tags, which are exposed to more severe environment than the liner free heat-sensitive recording adhesive sheets used for containers or packaging of foodstuff. In a roll of conventional liner free heat-sensitive adhesive sheets in which the surface of a release layer is in contact with the surface of the adhesive layer, if the cohesion between the release layer and the barrier layer which is formed on the heat-sensitive recording layer is low, there is a possibility that the release layer will be partly removed and adhere to the adhesive layer, especially when the adhesive sheet is exposed to high temperature and high humidity conditions.

The liner free heat-sensitive recording adhesive sheets disclosed in the above publications tend to suffer insufficient adhesion of the adhesive layer and blurring of the recorded images, and therefore remains to be improved.

SUMMARY OF THE INVENTION

It is an object of the present invention to provide novel liner free heat-sensitive recording adhesive sheets which are excellent in the recording sensitivity and printer runability as well as in cohesion between a barrier layer and a release layer.

The liner free heat-sensitive recording adhesive sheets of the present invention comprise

- a substrate,
- a heat-sensitive recording layer formed on one face of the substrate,
- a barrier layer formed on the heat-sensitive recording layer,
- a release layer formed on the barrier layer, and
- an adhesive layer formed on the other face of the substrate, wherein the barrier layer is formed from a coating composition comprising colloidal silica and at least one member selected from the group consisting of water-soluble resins and water-dispersible resins.

The inventors conducted extensive research and found that the liner free heat-sensitive recording adhesive sheets as set forth above are excellent in recording sensitivity and printer runability and also are excellent in cohesion between the barrier layer and the release layer. The present invention was accomplished based on this finding.

BRIEF DESCRIPTION OF THE DRAWINGS

In the drawings, the identical layers are indicated by the identical numerals.

DETAILED DESCRIPTION OF THE INVENTION

1. Substrate

Figure 1:
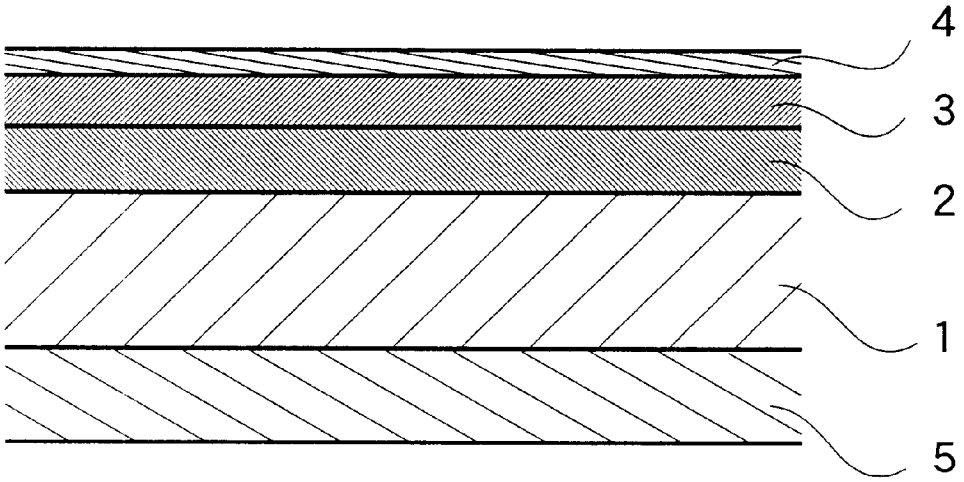
FIG. 1 is a schematic cross-sectional view of the heat-sensitive recording adhesive sheet of the present invention which comprises successively a heat-sensitive recording layer 2, a barrier layer 3 and a release layer 4 on one face of the substrate 1 and an adhesive layer 5 on the other face of the substrate 1.
Figure 2:
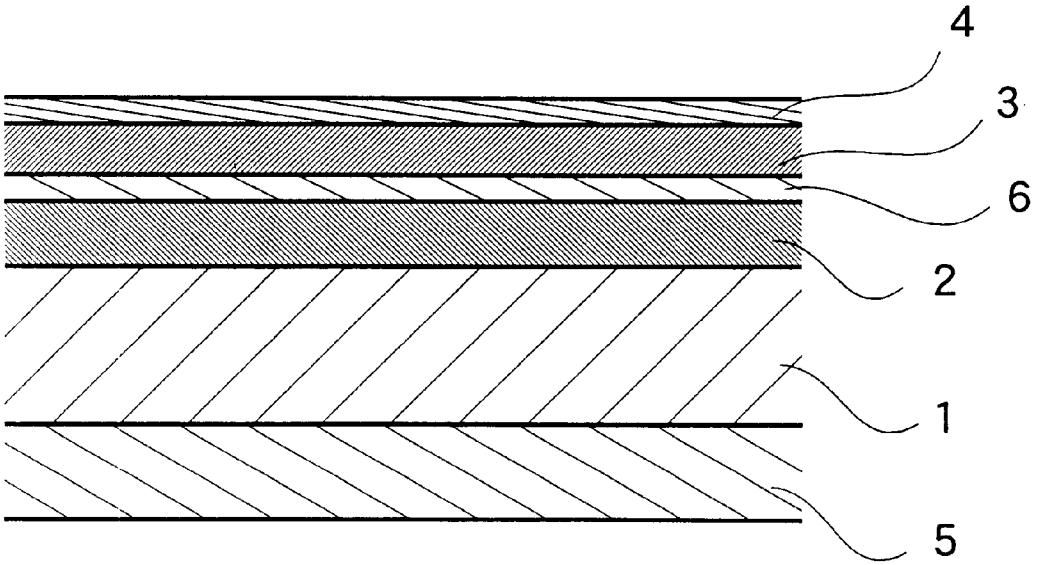
FIG. 2 is a schematic cross-sectional view of the heat-sensitive recording adhesive sheet of the present invention in which an intermediate layer 6 is further provided between a heat-sensitive recording layer 2 and a barrier layer 3.

The substrates used in the present invention include, for example, woodfree paper (neutralized paper, acidic paper), plastic film, synthetic paper, non-woven fabrics and the like. When woodfree paper is used as the substrate, the surface of woodfree paper may be treated with fluorine-containing resin to thereby improve preservability of the recording images.

2. Heat-sensitive Recording Layer

As the heat-sensitive recording system which may be used in the present invention, there may be mentioned, for example, a combination of a leuco dye and a color developing agent, a combination of a diazonium salt and a coupler, a combination of a chelate compound of a transition metal such as iron and a color developing agent, a combination of an aromatic isocyanate compound and an imino compound, etc. Of those exemplified, the combination of a leuco dye and a color developing agent is preferred since such a combination is excellent in color density of the recording image.

A variety of known leuco dyes and color developing-agents may be used.

Leuco dyes useful in the present invention include, for example, 3-(N-ethyl-N-isoamyl)amino-6-methyl-7-anilinofluoran, 3-(N-methyl-N-cyclohexyl)amino-6-methyl-7-anilinofluoran, 3-dimethylamino-6-methyl-7-anilinofluoran, 3-diethylamino-6-methyl-7-anilinofluoran, 3-di(n-butyl)amino-6-methyl-7-anilinofluoran, 3-di(n-pentyl)amino-6-methyl-7-anilinofluoran, 3-di(n-butyl)amino-7-(o-chlorophenylamino)fluoran, 3-diethylamino-7-(o-fluorophenylamino)fluoran, 3-(N-ethyl-p-toluidino)-6-methyl-7-anilinofluoran, 3-(N-ethyl-N-tetrahydrofurfurylamino)-6-methyl-7-anilinofluoran, 3-diethylamino-6-chloro-7-anilinofluoran, 3-(N-methyl-N-n-propylamino)-6-methyl-7-anilinofluoran, 3-di(n-butyl)amino-6-methyl-7-m-toluidinofluoran, 3-(N-n-hexyl-N-ethyl)amino-6-methyl-7-anilinofluoran, 3-(N-ethyl-N-isobutyl)amino-6-methyl-7-anilinofluoran, 3-diethylamino-6-methyl-7-p-ethoxyanilinofluoran, 3-pyrrolidino-6-methyl-7-anilinofluoran, 3-piperidino-6-methyl-7-anilinofluoran, 2,2-bis{4-[6'-(N-cyclohexyl-N-methylamino)-3'-methylspiro[phthalide-3,9'-xanthene-2'-ylamino]phenyl}propane, 3-diethylamino-7-(3'-trifluoromethylphenyl)aminofluoran, 3-cyclohexylamino-6-chlorofluoran, 3-diethylamino-6-methyl-7-chlorofluoran, 3-diethylamino-7-chlorofluoran, 3,3-bis[1-(4-methoxyphenyl)-1-(4-dimethylaminophenyl)ethylene-2-yl]-4,5,6,7-tetrachlorophthalide, 3,3-bis[l-(4-methoxyphenyl)-1-(4-pyrrolidinophenyl)ethylene-2-yl]-4,5,6,7-tetrachlorophthalide, 3-[p-(p-anilinoanilino)anilino]-6-methyl-7-chlorofluoran, etc.

Leuco dyes are not limited to those mentioned above, and two or more of these may be used in admixture. Of those dyes mentioned above, 3-di(n-butyl)amino-6-methyl-7-anilinofluoran is preferably used from the standpoint of color density, recording sensitivity and preservability of the recording images as well as stability of uncolored (non-recorded) parts.

The leuco dye is used in an amount of about 5 to 40% by weight based on the total solids of the heat-sensitive recording layer.

Color developing agents useful in the present invention include, for example, phenol compounds such as 4,4'-isopropylidenediphenol, 1,1-bis(4-hydroxyphenyl)cyclohexane, 2,2-bis(4-hydroxyphenyl)-4-methylpentane, 4,4'-dihydroxydiphenylsulfide, hydroquinonemonobenzylether, Benzyl 4-hydroxybenzoate, 4,4'-dihydroxydiphenylsulfone, 2,4'-dihydroxydiphenylsulfone, 4-hydroxy-4'-isopropoxydiphenylsulfone, 3,3'-diallyl-4,4'-dihydroxydiphenylsulfone, 4-hydroxy-4'-methyldiphenylsulfone, 4-hydroxyphenyl-4'-benzyloxyphenylsulfone, butyl bis(p-hydroxyphenyl)acetate, 1,1-bis(4-hydroxyphenyl)-1-phenylethane, 1,4-bis[α-methyl-α-(4'-hydroxyphenyl)ethyl]benzene, 1,3-bis[α-methyl-α-(4'-hydroxyphenyl)ethyl]benzene, di(4-hydroxy-3-methylphenyl)sulfide, 2,2'-thiobis(3-tert-octylphenol), 2,2'-thiobis(4-tert-octylphenol), 2,4-dihydroxy-2'-methoxybenzanilide, etc.; compounds having one or more —$SO_2NH$ bonds within the molecule, such as N-p-tolylsulfonyl-N'-phenylurea, 4,4'-bis(p-toluenesulfonylaminocarbonylamino)diphenylmethane, N-p-tolylsulfonyl-N'-(p-tolyl)urea; aromatic carboxylic acids, e.g., p-chlorobenzoic acid, 4-[2-(p-methoxyphenoxy)ethyloxy]salicylic acid, 4-[3-(p-tolylsulfonyl)propyloxy]salicylic acid, 5-[p-(2-p-methoxyphenoxyethoxy)cumyl]salicylic acid, etc., salts of the aromatic carboxylic acid with a polyvalent metal such as zinc, magnesium, aluminum, calcium, titanium, manganese, tin and nickel.

Of the color developing agents exemplified above, 4-hydroxy-4'-isopropoxydiphenylsulfone and 3,3'-diallyl-4,4'-dihydroxydiphenylsulfone are preferably used since they give record images having excellent long time storage stability and having resistance to moisture. In addition, 1,1-bis(4-hydroxyphenyl)-1-phenylethane, zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl]salicylate, zinc 4-n-octyloxycarbonylamino salicylate and the like are preferably used when the resulting heat-sensitive recording adhesive sheet is stored for a long period of time, because these zinc compounds are not susceptible to unfavorable effects produced by the adhesive of the adhesive layer, especially the adverse effects produced by the emulsifiers or residual monomers included in acrylic resin adhesives, which lead to impairment of color developing ability.

The ratio of a leuco dye to a color developing agent is suitably selected depending on the species of the leuco dye and the color developing agents used, and the ratio is not specifically limited. Generally, the color developing agent is used in an amount of 1 to 10 parts by weight, preferably about 1 to 5 parts by weight, per part by weight of the leuco dye.

If desired, the heat-sensitive recording layer may contain a preservability improving agent to increase preservability of the recording images or may contain a sensitizer to increase recording sensitivity.

Specific examples of such preservability improving agents include hindered phenol compounds such as 2,2'-ethylidenebis(4,6-di-tert-butylphenol), 4,4'-thiobis(2-methyl-6-tert-butylphenol), 1,1,3-tris(2-methyl-4-hydroxy-5-tert-butylphenyl)butane, 1,1,3-tris(2-methyl-4-hydroxy-5-cyclohexylphenyl)butane, 2,2-bis(4-hydroxy-3,5-dimethylphenyl)propane, etc.; epoxy compounds such as 1,4-diglycidyloxybenzene, 4,4'-diglycidyloxydiphenylsulfone, 4-benzyloxy-4'-(2-methylglycidyloxy)diphenylsulfone, diglycidyl telephthalate, cresol-novolak type epoxy resin, phenol-novolak type epoxy resin, bisphenol A type epoxy resin, etc.; N,N'-di-2-naphthyl-p-phenylenediamine, sodium salt or multivalent metal (e.g., calcium, magnesium) salts of 2,2'-methylenebis(4,6-di-tert-butylphenyl)phosphate, bis(4-ethyleneiminocarbonyl-aminophenyl)methane, etc.

Examples of sensitizers include stearic acid amide, methylenebis stearic acid amide, dibenzyl telephthalate, benzyl p-benzyloxybenzoate, 2-naphthyl benzyl ether, m-terphenyl, p-benzylbiphenyl, p-tolyl biphenyl ether, di(p-methoxyphenoxyethyl) ether, 1,2-di(3-methylphenoxy)ethane, 1,2-di(4-methylphenoxy)ethane, 1,2-di(4-methoxyphenoxy)ethane, 1,2-di(4-chlorophenoxy)ethane, 1,2-diphenoxyethane, 1-(4-methoxyphenoxy)-2-(3-methylphenoxy)ethane, p-methylthiophenyl benzyl ether, 1,4-di(phenylthio)butane, p-acetotoluidide, p-acetophenetidide, N-acetoacetyl-p-toluidine, di(β-biphenylethoxy)benzene, di-p-chlorobenzyl oxalate, di-p-methylbenzyl oxalate, dibenzyl oxalate, etc.

The amounts of the preservability improving agent and the sensitizer to be included are not specifically limited, but generally the amount each of the preservability improving agent and the sensitizer is adjusted to 4 parts by weight or less, preferably about 0.2 to 2 parts by weight, per part by weight of the color developing agent, respectively.

The heat-sensitive recording layer is generally formed by applying a coating composition for forming the heat-sensitive recording layer to one face of the substrate, followed by drying. The coating composition for forming the heat-sensitive recording layer is prepared by dispersing a leuco dye, a color developing agent, and if desired, a sensitizer and a preservability improving agent, either conjointly or separately, with use of an agitating and pulverizing means such as a ball-mill, an attritor, a sand mill or the like, to give particles having an average particle size of 2 $\mu$m or less, and adding to the dispersion a water-soluble resin and/or a water-dispersible resin.

Examples of the water-soluble resin and/or water-dispersible resin to be added to the coating composition for forming the heat-sensitive recording layer include starches, hydroxyethyl cellulose, methyl cellulose, carboxymethyl cellulose, gelatin, casein, gum arabic, polyvinyl alcohols, carboxyl-modified polyvinyl alcohols, acetoacetyl group-modified polyvinyl alcohols, silicon-containing polyvinyl alcohols, diisobutylene-maleic anhydride copolymer salts, styrene-maleic anhydride copolymer salts, ethylene-acrylic acid copolymer salts, styrene-acrylic acid copolymer salts, urea resins, melamine resins, amide resins, polyester-polyurethane latex, acrylic latex, styrene-butadiene latex, etc. As the salt of the copolymers described above, sodium salt, potassium salt, ammonium salt and the like may be exemplified.

Of the water-soluble resin and/or water-dispersible resin listed above, polyvinyl alcohols, carboxyl-modified polyvinyl alcohols, acetoacetyl group-modified polyvinyl alcohols, silicon-containing polyvinyl alcohols and the like are preferred, since they give a heat-sensitive recording layer having excellent cohesion to the barrier layer. The amount of the water-soluble resin and/or the water-dispersible resin to be used is not specifically limited, but preferably is in the range of about 5 to 40% by weight, particularly about 10 to 30% by weight, based on the total solids of the heat-sensitive recording layer.

To the coating composition for forming the heat-sensitive recording layer may be added a water-resisting agent, if so desired. Water-resisting agents to be used in the present invention include, for example, glyoxal, boric acid, dialdehyde starch, methylol urea, epoxy compounds (e.g., polyamide epoxy resins, glycerol polyglycidyl ether and the like), etc. The amount of the water-resisting agent to be added is not specifically limited, but is preferably in the range of 0.01 to 10% by weight, particularly about 0.1 to 5% by weight, based on the total solids of the heat-sensitive recording layer.

Further, if necessary, various kinds of auxiliaries may be added to the coating composition for forming the heat-sensitive recording layer. Such auxiliaries are, for example, pigments such as kaolin, precipitated (or ground) calcium carbonate, calcined kaolin, titanium oxide, magnesium carbonate, aluminum hydroxide, amorphous silica, urea-formalin resin filler; surfactants such as sodium dioctylsulfosuccinate, sodium dodecylbenzenesulfonate, sodium salt of lauryl alcohol sulfuric acid ester, fatty acid metallic salts, etc.; waxes such as zinc stearate, calcium stearate, polyethylene wax, carnauba wax, paraffin wax, ester wax, etc.; hydrazide compounds, antifoaming agents and dyes.

The amount of the auxiliary to be used is not specifically limited, but preferably is in the range of about 0.01 to 20% by weight, particularly about 0.1 to 10% by weight, based on the total solids of the heat-sensitive recording layer.

The method for forming the heat-sensitive recording layer is not specifically limited. The heat-sensitive recording layer is formed, for example, by applying the coating composition for forming the heat-sensitive recording layer to one face of the substrate in an amount of 2 to 12 g/m$^2$, preferably about 3 to 7 g/m$^2$, on dry weight basis by airknife coating, varibar blade coating, pureblade coating, rodblade coating, short dwell coating, curtain coating, die coating or the like, followed by drying.

3. Barrier Laser

According to the present invention, the specific barrier layer is formed on the heat-sensitive recording layer by applying thereto a coating composition for forming the barrier layer, the coating composition comprising colloidal silica and at least one member selected from the group consisting of water-soluble resins and water-dispersible resins. The resulting barrier layer gives an improved cohesion between the barrier layer and the release layer and increased ability of the release layer to easily release from the adhesive layer, and further is effective in increasing printer runability and recording sensitivity.

The amount of colloidal silica (calculated as solids) is not specifically limited. If the amount of colloidal silica is less than 5% by weight based on the total solids of the barrier layer, the cohesion between the barrier layer and the release layer is likely to become insufficient. On the other hand, if the amount is more than 60% by weight, release ability of the release layer might be impaired. Therefore, the amount of colloidal silica to be used is preferably in the range of about 5 to 60% by weight, (particularly about 10 to about 40% by weight) calculated as solids, based on the total solids of the barrier layer.

The coating composition for forming the barrier layer is prepared by admixing, in the presence of water as a dispersing medium, at least one member selected from the group consisting of water-soluble resins and water-dispersible resins with colloidal silica having an average particle size of about 5 to 50 nm.

Unlike amorphous silica usually obtained by dry method, aerogel method, wet method or the like and composed of secondary particles having a particle size of 0.1 to 10 $\mu$m, colloidal silica for use in the present invention is in the form of a colloid which contains water as a dispersing medium and which contains primary particles having an average particle size of about 5 to 50 nm.

In general, the colloidal silica is prepared by using sodium silicate as the starting material. Colloidal silica used in the present invention preferably has a pH in the range of about 5 to 11 and contains residual sodium oxide in an amount of less than 0.5% by weight. The colloidal silica in which colloidal silica particles are surface-treated with aluminium is particularly preferred since such colloidal silica imparts excellent storage stability to the coating composition for forming the barrier layer. The colloidal silica in which colloidal particles are surface-treated with aluminium is prepared, for example, by reacting the silanol surfaces of the colloidal silica particles with sodium aluminate. And the colloidal silica which is treated with ammonia is also particularly preferred since such colloidal silica has little residual alkali metal after dried, so it gives less corrosivity to the thermal printing heads.

As said at least one member selected from the group consisting of water-soluble resins and water-dispersible resins to be included in the coating composition for forming the barrier layer, there may be mentioned various resins that are conventionally used. Examples of such water-soluble resins include starches such as starch, oxidized starch, etc.; celluloses such as hydroxyethyl cellulose, methyl cellulose, carboxymethyl cellulose, etc.; casein, gelatin, gum arabic; polyvinyl alcohols such as totally (or partially) saponified polyvinyl alcohols, carboxyl-modified polyvinyl alcohols, acetoacetyl group-modified polyvinyl alcohols, silicon-containing polyvinyl alcohols, etc.; diisobutylene-maleic acid copolymer sodium salts, ethylene-acrylic acid copolymer ammonium salts; copolymers mainly comprising styrene and one or more ethylenically unsaturated carboxylic acid salts such as styrene-maleic acid copolymer ammonium salts, styrene-acrylic acid copolymer sodium salts, styrene-itaconic acid copolymer sodium salts, etc.; urea resins, melamine resins, amide resins, etc. Examples of said water-dispersible resins are styrene-butadiene latex, polyester-polyurethane latex, styrene-acrylic latex, etc.

Of said at least one member selected from the group consisting of water-soluble resins and water-dispersible resins listed above, acetoacetyl-modified polyvinyl alcohol, casein, or a copolymer comprising styrene and a salt of ethylenically unsaturated carboxylic acid such as maleic acid, acrylic acid or itaconic acid are preferably used because they give a barrier layer which is excellent in adhesion. Examples of the salts of said ethylenically unsaturated carboxylic acid are ammonium salt, sodium salt, potassium salt and the like.

Especially, among the copolymers comprising styrene and a salt of ethylenically unsaturated carboxylic acid, those having an acid value of 40 to 80 mg KOH/g resin, particularly 45 to 60 mg KOH/g resin, are preferred, since the use of such copolymers reduces or minimizes the adverse effect of the adhesive contained in the adhesive layer on the heat-sensitive layer, namely occurrence of fogging and decrease in color forming ability. Herein, the acid value is defined as the number of milligrams of KOH required to neutralize 1 g of said copolymer.

When acetoacetyl-modified polyvinyl alcohols are used, those having a degree of acetoacetylation of about 0.1 to 10 mole %, a polymerization degree of about 200 to 2,500, and a saponification value of 80 to 100% are preferred. Herein, the degree of acetoacetylation is defined as the percentage (mole %) of the amount of acetoacetyl groups contained in the acetoacetyl-modified-polyvinyl alcohol relative to the amount of hydroxyl groups, residual acetyl groups and acetoacetyl groups.

The amount of said at least one member selected from the group consisting of water-soluble resins and water-dispersible resins to be included is in the range of about 30 to 95% by weight, preferably about 40 to 80% by weight, based on the total solids of the barrier layer.

In addition to colloidal silica, it is also possible to add various known pigments to the coating composition for forming the barrier layer so long as the desired effects of the present invention are not impaired. Specific examples of such pigments include calcium carbonate, zinc oxide, aluminum oxide, titanium dioxide, aluminum hydroxide, barium sulfate, talc, kaolin, clay, calcined kaolin, urea-formalin resin filler, etc.

The amount of the pigment is not specifically limited, but it is preferable that the combined amount of the pigment and the solids content of the colloidal silica is in the range of 10 to 70% by weight, particularly 15 to 60% by weight, based on the total solids of the barrier layer.

To the coating composition for forming the barrier layer may be added a water-resisting agent. Examples of the water-resisting agent to be used in the present invention include, for example, glyoxal, formalin, polyamide epoxy resin, polyhydrazide, dimethylol urea, boric acid, borax, etc. The amount of the water-resisting agent used is not specifically limited, but preferably is in the range of about 0.01 to 20% by weight, particularly about 0.1 to 10% by weight, based on the total solids of the barrier layer.

Further, if desired, various kinds of auxiliaries may be added to the coating composition for forming the barrier layer. Such auxiliaries are, for example, surfactants such as sodium dioctylsulfosuccinate, sodium dodecylbenzenesulfonate, sodium salt of lauryl alcohol sulfuric acid ester, fatty acid metallic salts, etc.; waxes such as zinc stearate, calcium stearate, polyethylene wax, carnauba wax, paraffin wax, ester wax, etc.; antifoaming agents and dyes.

The amount of the auxiliary to be included is not specifically limited, but preferably is in the range of about 0.01 to 10% by weight, especially about 0.1 to 5% by weight, based on the total solids of the barrier layer.

The coating composition for forming the barrier layer is prepared by dispersing at least one member selected from the group consisting of water-soluble resins and water-dispersible resins, colloidal silica, and if desired, the above pigment, water-resisting agent and auxiliary in water to homogeneity.

The coating composition for forming the barrier layer preferably has a solid content of about 5 to 50% by weight, particularly 15 to 40% by weight.

The method for forming the barrier layer is not specifically limited. The barrier layer is generally formed by applying the coating composition for forming the barrier layer to the heat-sensitive recording layer by, for example, airknife coating, varibar blade coating, pureblade coating, rodblade coating, short dwell coating, curtain coating, die coating or the like, followed by drying.

When an intermediate layer to be described below is provided, the barrier layer is formed by applying the coating composition for forming the barrier layer to the intermediate layer.

The amount of the coating composition for forming the barrier layer is not specifically limited. Generally the composition is applied in an amount of about 0.5 to 10 g/m$^2$, preferably about 1 to 5 g/m$^2$, on dry weight basis.

4. Release Layer

The heat-sensitive adhesive recording sheet of the present invention is free of the release liner since the sheet comprises successively a barrier layer and a release layer on the heat-sensitive recording layer and an adhesive layer on the opposite face of the substrate. The release layer is preferably formed by applying to the barrier layer a coating composition for forming the release layer mainly comprising a UV curable silicone compound or an electron beam curable silicone compound, and curing the coating layer by ultraviolet rays irradiation or electron beam irradiation.

The silicone compounds to be used in the present invention are those conventionally used in the art and include, for example, a composition comprising a mercapto group-containing organopolysiloxane and a vinyl group-containing organopolysiloxane; acryloyl group, methacryloyl group or cinnamoyl group-containing organopolysiloxanes; maleimido group or phenylmaleimido group-containing organopolysiloxanes; a composition comprising an azido group-containing organopolysiloxane and a vinyl group-containing polysiloxane; thioacryloyl group, thiomethacryloyl group or thiocinnamoyl group-containing organopolysiloxanes; and acrylamido group, methacrylamido group or cinnamoylamido group-containing organopolysiloxanes, etc.

When a UV curable silicone compound is used, it is necessary to use a polymerization initiator. Specific examples of the polymerization initiator include those conventionally used, such as benzoyl alkyl ether and the derivatives thereof, acetophenone and the derivatives thereof, thioxanthone and the derivatives thereof, etc. The amount of the polymerization initiator to be used is about 0.01 to 10 parts by weight, preferably about 0.1 to 5 parts by weight, per 100 parts by weight of the silicone compound.

The coating composition for forming the release layer is the above silicone compound per se, which contains a polymerization initiator, if so desired.

The amount of the coating composition for forming the release layer to be applied is 0.3 to 5 g/m$^2$, preferably about 0.5 to about 3 g/m$^2$. The coating composition for forming the release layer is usually applied to the entire surface of the barrier layer, but in some occasions may be applied to a part of the surface of the barrier layer.

Considering the thermal printing head-matching properties during recording, optical surface roughness of the release layer surface (Rp value) is preferably adjusted to 0.1 to 2.0 $\mu$m, more preferably to 0.3 to 1.5 $\mu$m, as measured according to JIS B 0652 so as to achieve good head-cleaning effect and excellent printer runability. The optical surface roughness less than 0.1 $\mu$m results in insufficient cleaning effect, whereas the optical surface roughness more than 2.0 $\mu$m is likely to impair the quality of the recording images.

The surface roughness of the release layer surface can be adjusted to the above range by a conventional method, for example, by supercalendering.

5. Adhesive Layer

The adhesives used in the adhesive layer are not specifically limited, and various adhesives conventionally used in the field of heat-sensitive recording adhesive sheets may be used. For example, hot-melt adhesives such as natural rubber or the like and latex adhesives such as acrylic resin latex adhesives and styrene-butadiene copolymer latex adhesives are used. In respect of adhesion, adhesives of the general-purpose type, strong adhesion type, low-temperature adhering type, releasable type and the like are used in the present invention. Adhesion can be controlled by various methods, such as, by selecting resins in the case of using the latex adhesives or by changing the size of the dots formed by the gravure coating in the case of using the hot-melt adhesives.

The coating composition for forming the adhesive layer is, e.g., latex itself when using one of the latex adhesives.

The coating composition for forming the adhesive layer preferably has a solid content of about 30 to 55% by weight, particularly 40 to 55% by weight.

The amount of the coating composition for forming the adhesive layer to be applied is 3 to 50 g/m$^2$, preferably about 5 to 30 g/m$^2$, on dry weight basis. The coating composition for forming the adhesive layer is applied to the entire surface (opposite face) of the substrate, but in some occasions may be applied to a part of the opposite face of the substrate.

As the method for forming the adhesive layer, there may be mentioned a method comprising directly applying the composition to the opposite face of the substrate and a method comprising applying the composition to the release layer and then winding the resulting sheet into a roll to thereby transfer the adhesive layer to the opposite face of the substrate. Either method may be employed in the present invention.

6. Intermediate Layer

According to a preferred embodiment of the present invention, an intermediate layer is provided, if so desired, between the heat-sensitive recording layer and the barrier layer to reduce the occurrence of fogging and decrease in color forming ability.

The coating composition for forming the intermediate layer is prepared by uniformly dispersing in water at least one member selected from the group consisting of water-soluble resins and water-dispersible resins described above with respect to the barrier layer, and if desired, a water-resisting agent and an auxiliary mentioned above with respect to the barrier layer.

The amount of said at least one member selected from the group consisting of water-soluble resins and water-dispersible resins to be used is in an amount of about 50 to 100% by weight, particularly about 70 to 100% by weight, based on the total solids of the intermediate layer.

The amount of the water-resisting agent, if used, is in an amount of about 5 to 50% by weight, particularly about 5 to 30% by weight, based on the total solids of the intermediate layer.

The amount of the auxiliary, if used, is in an amount of about 5 to 50% by weight, particularly about 5 to 30% by weight, based on the total solids of the intermediate layer.

It is preferable that the coating composition for forming the intermediate layer has a solid content of about 5 to 50% by weight, preferably about 15 to 40% by weight.

The amount of the coating composition for forming the intermediate layer to be applied is not specifically limited, but generally is adjusted to the range of 0.5 to 10 g/m$^2$, preferably about 1 to 5 g/m$^2$, on dry weight basis.

If necessary, a barrier layer or an intermediate layer may be further provided between the heat-sensitive recording layer and the substrate or between the substrate and the adhesive layer so as to reduce the adverse effect on the color developing agent in the heat-sensitive recording layer, caused by the adhesive from the opposite side of the substrate.

Such a barrier layer and an intermediate layer can be formed in the same manner as described above in item 3 and item 6, respectively.

7. Undercoat Layer

Since the adhesive sheet according to the present invention comprises the barrier-layer and the release layer on the heat-sensitive recording layer, it is preferred to provide between the substrate and the heat-sensitive recording layer an undercoat layer which comprises a resin and an inorganic pigment or a hollow organic pigment composed of a thermoplastic resin having an oil absorption of 80 to 300 ml/100 g as measured according to JIS K 5101.

Specific examples of the pigment include calcined kaolin, amorphous silica, urea-formalin resin filler, etc.

The resins to be used in the undercoat are not specifically limited. For example, the above-mentioned water-soluble resins and water-dispersible resins which are added to the coating composition for forming the heat-sensitive recording layer may be used.

The coating composition for forming the undercoat layer may be prepared by uniformly dispersing the above inorganic pigment or a hollow organic pigment in water containing the resin.

The coating composition for forming the undercoat layer preferably has a solid content of about 10 to 65% by weight, particularly about 30 to 50% by weight.

The amount of the coating composition for forming the undercoat layer is not specifically limited, but preferably is in the range of 3 to 20 g/m$^2$, especially about 5 to 15 g/m$^2$, on dry weight basis.

In the present invention, after forming each of the layers, it is possible to carry out smoothing treatment such as supercalendering or the like. Moreover, if desired, a variety of treatments known in the field of the heat-sensitive recording materials are employed. For example, perforations may be made in the sheet, or the adhesive layer is formed, by printing, on the predetermined area other than the edges or the perforations.

Unlike the heat-sensitive recording adhesive sheet which comprises a release liner, the liner free heat-sensitive recording adhesive sheet is impossible to be cut out into various shapes. However, by printing a variety of patterns or designs on the heat-sensitive recording layer or on the barrier layer, the adhesive label affixed on bottles or the like looks as if it is a label of apparently complicated shape.

EXAMPLES

The following examples are provided to further illustrate the present invention, but it should be understood that, the invention is not limited to the examples. Parts and percentages in the examples are all by weight unless otherwise indicated.

Example 1

1) Preparation of a Coating Composition for Forming an Undercoat Layer

One hundred parts of calcined kaolin (oil absorption: 110 ml/100 g), 1 part of a 40% aqueous solution of polyacrylic acid sodium salt, 14 parts of styrene-butadiene latex having a solids content of 48%, 50 parts of a 10% aqueous solution of polyvinyl alcohol (polymerization degree: 1000, saponification value: 99 mole %) and 100 parts of water were mixed and stirred to prepare a coating composition for forming an undercoat layer.

2) Preparation of Dispersion A

A mixture of 10 parts of 3-di-(n-butyl)amino-6-methyl-7-anilinofluoran, 5 parts of a 5% aqueous solution of methyl cellulose and 40 parts of water was pulverized using a sandmill to provide particles having an average particle size of 1.0 $\mu$m.

3) Preparation of Dispersion B

A mixture of 30 parts of 4-hydroxy-4'-isopropoxydiphenylsulfone, 5 parts of a 5% aqueous solution of methyl cellulose and 80 parts of water was pulverized using a sandmill to give particles having an average particle size of 1.0 $\mu$m.

4) Preparation of Dispersion C

A mixture of 20 parts of 1,2-di(3-methylphenoxy)ethane, 5 parts of a 5% aqueous solution of methyl cellulose and 55 parts of water was pulverized using a sandmill to give particles having an average particle size of 1.0 $\mu$m.

5) Preparation of a Coating Composition for Forming a Heat-sensitive Recording Layer Fifty-five (55) parts of Dispersion A, 115 parts of Dispersion B, 80 parts of Dispersion C, 160 parts of a 10% aqueous solution of polyvinyl alcohol (polymerization degree: 1000, saponification value: 99 mole %), 20 parts of styrene-butadiene latex having a solids content of 50%, 1 part of a 40% aqueous solution of glyoxal (water-resisting agent) and 17 parts of precipitated calcium carbonate were mixed and stirred to give a coating composition for forming a heat-sensitive recording layer.

6) Preparation of a Coating Composition for Forming a Barrier Layer

One hundred parts of a 10% aqueous solution of acetoacetyl-modified polyvinyl alcohol (degree of acetoacetylation: 3 mole %, polymerization degree: 1000, saponification value: 99 mole %) and 50 parts of colloidal silica (pH: 9) in which silica particles had been surface-treated with aluminium were mixed and stirred to give a coating composition for forming the barrier layer.

The colloidal silica used comprised primary particles having an average particle size of 20 nm and a solid content of 20%.

7) Preparation of a Coating Composition for Forming a Release Layer

One hundred parts of a solventless UV curable silicone (a mixture of 30 parts of a mercapto group-containing organopolysiloxane (mercapto group content: 1.5 mole %) and 70 parts of a vinyl group-containing organopolysiloxane (vinyl group content:1.5 mole %) and 3 parts of acetophenone (polymerization initiator) were mixed and stirred to provide a coating composition for forming the release layer.

8) Production of a Heat-sensitive Recording Adhesive Sheet

To one face of neutralized woodfree paper weighing 64 g/m$^2$ was applied the coating composition for forming an undercoat layer in an amount of 9 g/m on dry weight basis, followed by drying, to form an undercoat layer.

To the undercoat layer was applied the coating composition for forming a heat-sensitive recording layer in an amount of 6 g/m$^2$ on dry weight basis, followed by drying, to form a heat-sensitive recording layer.

To the heat-sensitive recording layer was applied the coating composition for forming a barrier layer in an amount of 4 g/m$^2$ on dry weight basis, followed by drying, to form a barrier layer.

The resulting sheet was supercalendered.

To the barrier layer was applied the coating composition for forming a release layer in an amount of 1.0 g/m$^2$, and the coating was cured by irradiation of UV rays, to thereby form a release layer.

Then, to the other face of the woodfree paper was applied an acrylic resin adhesive latex (Acryset TS 1105, tradename, Nippon Shokubai Co., Ltd.) having a solid content of 50% in an amount of 20 g/m$^2$ on dry weight basis to form an adhesive layer. Thereafter, the resulting sheet was wound into a roll to provide a liner free heat-sensitive recording adhesive sheet.

Example 2

Following the procedure of Example 1 and using 100 parts of a 10% aqueous solution of casein prepared by dissolving casein in water with use of ammonia in lieu of 100 parts of a 10% aqueous solution of acetoacetyl-modified polyvinyl alcohol (degree of acetoacetylation: 3 mole %, polymerization degree: 1000, saponification value: 99 mole %) in the preparation of the coating composition for forming the barrier layer, a liner free heat-sensitive recording adhesive sheet was prepared.

Example 3

Following the procedure of Example 1 and using 40 parts of a 20% aqueous solution of ammonium salt of styrene-acrylic acid copolymer (acid value: 45), 20 parts of a 10% aqueous solution of polyvinyl alcohol (polymerization degree: 500, saponification value: 99 mole %) and 1 part of dimethylol urea (water-resisting agent) in lieu of 100 parts of a 10% aqueous solution of an acetoacetyl-modified polyvinyl alcohol (degree of acetoacetylation: 3 mole %, polymerization degree: 1000, saponification value: 99 mole %) in the preparation of the coating composition for forming the barrier layer, a liner free heat-sensitive recording adhesive sheet was prepared.

Example 4

Following the procedure of Example 3 and using 40 parts of a 20% aqueous solution of sodium salt of styrene-acrylic acid copolymer (acid value: 30), in lieu of 40 parts of a 20% aqueous solution of ammonium salt of styrene-acrylic acid copolymer (acid value: 45), a liner free heat-sensitive recording adhesive sheet was prepared.

Example 5

Following the procedure of Example 3 and using 40 parts of a 20% aqueous solution of ammonium salt of styrene-acrylic acid copolymer (acid value: 90) in lieu of 40 parts of a 20% aqueous solution of ammonium salt of styrene-acrylic acid copolymer (acid value: 45), a liner free heat-sensitive recording adhesive sheet was prepared.

Example 6

Following the procedure of Example 1 and using 40 parts of a 20% aqueous solution of sodium salt of styrene-maleic acid copolymer (acid value: 60), 20 parts of a 10% aqueous solution of polyvinyl alcohol (polymerization degree: 500, saponification value: 99 mole %) and 1 part of dimethylol urea (water-resisting agent) in lieu of 100 parts of a 10% aqueous solution of acetoacetyl-modified polyvinyl alcohol (degree of acetoacetylation: 3 mole %, polymerization degree: 1000, saponification value: 99 mole %) in the preparation of the coating composition for forming a barrier layer, a liner free heat-sensitive recording adhesive sheet was prepared.

Example 7

Following the procedure of Example 1 and using 100 parts of a 10% aqueous solution of polyvinyl alcohol (polymerization degree: 1000, saponification value: 99 mole %) in lieu of 100 parts of a 10% aqueous solution of acetoacetyl-modified polyvinyl alcohol (degree of acetoacetylation: 3 mole %, polymerization degree: 1000, saponification value: 99 mole %) in the preparation of the coating composition for forming a barrier layer, a liner free heat-sensitive recording adhesive sheet was prepared.

Example 8

Following the procedure of Example 1 and using 25 parts of a styrene-acryl latex having a solid content of 40% in lieu of 100 parts of a 10% aqueous solution of acetoacetyl-modified polyvinyl alcohol (degree of acetoacetylation: 3 mole %, polymerization degree: 1000, saponification value: 99 mole %) in the preparation of the coating composition for forming a barrier layer, a liner free heat-sensitive recording adhesive sheet was prepared.

Example 9

Following the procedure of Example 1 and using 5 parts of colloidal silica (pH:9) having a solid content of 20% in which colloidal silica particles had been surface-treated with aluminium and had an average particle size of 20 nm, in lieu of 50 parts of the same colloidal silica in the preparation of the coating composition for forming a barrier layer, a liner free heat-sensitive recording adhesive sheet was prepared.

Example 10

Following the procedure of Example 1 and using 100 parts of colloidal silica (pH:9) having a solid content of 20%, in which colloidal silica particles had been surface-treated with aluminium and had an average particle size of 20 nm, in lieu of 50 parts of the same colloidal silica in the preparation of the coating composition for forming a barrier layer, a liner free heat-sensitive recording adhesive sheet was prepared.

Example 11

Following the procedure of Example 1 and using 50 parts of an ammonia-stabilized colloidal silica (pH: 10) having a solid content of 20% in which colloidal silica particles had an average particle size of 10 nm, in lieu of 50 parts of the colloidal silica (pH: 9) having a solid content of 20% in which colloidal silica particles had been surface-treated with aluminium and had an average particle size of 20 nm in the preparation of the coating composition for forming a barrier layer, a liner free heat-sensitive recording adhesive sheet was prepared.

Example 12

Following the procedure of Example 11 and forming an intermediate layer on the heat-sensitive recording layer by applying the following coating composition for forming an intermediate layer to the heat-sensitive recording layer in an amount of 2 g/m$^2$ on dry weight basis, followed by drying, and then forming the barrier layer on the intermediate layer in the same manner as in Example 11, a liner free heat-sensitive recording adhesive sheet was prepared.

(i) Preparation of a Coating Composition for Forming an Intermediate Layer

One hundred parts of a 20% aqueous solution of ammonium salt of styrene-acrylic acid copolymer (acid value: 45), 40 parts of a 10% aqueous solution of polyvinyl alcohol (polymerization degree: 500, saponification value: 99%) and 1 part of dimethylol urea were mixed and stirred to give a coating composition for forming an intermediate layer.

Example 13

Following the procedure of Example 1 and using 3,3'-diallyl-4,4'-dihydroxydiphenylsulfone in lieu of 4-hydroxy-4'-isopropoxydiphenylsulfone in the preparation of Dispersion B, a liner free heat-sensitive recording adhesive sheet was prepared.

Example 14

Following the procedure of Example 1 and using 1,1-bis (4-hydroxyphenyl)-1-phenylethane in lieu of 4-hydroxy-4'-isopropoxydiphenylsulfone in the preparation of Dispersion B, a liner free heat-sensitive recording adhesive sheet was prepared.

Comparison Example 1

Following the procedure of Example 1 and using 50 parts of a dispersion of precipitated calcium carbonate (average particle size: 1 $\mu$m, solid content: 20%) in lieu of 50 parts of the colloidal silica (pH: 9, solid content: 20%) in which colloidal silica particles had been surface-treated with aluminium and had an average particle size of 20 nm, a liner free heat-sensitive recording adhesive sheet was prepared.

Comparison Example 2

Following the procedure of Example 1 without using 50 parts of the colloidal silica (pH: 9, solid content: 20%) in which colloidal silica particles had been surface-treated with aluminium and had an average particle size of 20 nm, a heat-sensitive recording adhesive sheet was prepared.

Comparison Example 3

Following the procedure of Example 1 and using 50 parts of an aqueous dispersion of an amorphous silica powder comprising secondary particles having an average particle size of 2.3 μm in lieu of the colloidal silica (pH: 9, solid content: 20%) in which colloidal silica particles had been surface-treated with aluminium and had an average particle size of 20 nm, a liner free heat-sensitive recording adhesive sheet was prepared.

Comparison Example 4

Following the procedure of Example 1 and using 50 parts of a dispersion of kaolin (average particle size: 0.8 μm, solid content: 20%) in lieu of 50 parts of the colloidal silica (pH: 9, solid content: 20%) in which colloidal silica particles had been surface-treated with aluminium and had an average particle size of 20 nm, a liner free heat-sensitive recording adhesive sheet was prepared.

Evaluation

The thus obtained heat-sensitive recording adhesive sheets were evaluated for the following properties (i)–(v) and the results are shown in Table 2.

(i) Color Forming Property

With use of a heat-sensitive recording tester (Model TH-PMD, manufactured by Ohkura Denki Kabushiki Kaisha), each of the heat-sensitive recording adhesive sheet was subjected to recording with an applied energy of 0.5 mJ/dot, and the color density of the thus obtained recording image was measured by Macbeth densitometer (Model RD-914, manufactured by Macbeth Corporation) under a visual mode.

(ii) Adhesion Between the Release Layer and the Adhesive Layer

The heat-sensitive recording adhesive sheet obtained above was cut into strips (5 cm in width and 10 cm in length). Then, one of the two strips of the sheet was superposed on the other strip, in such a manner that the surface of the release layer of one strip was brought into contact with the surface of the adhesive layer of the other strip. The superposed strips were pressed under a pressure of 10 kg weight/cm, and evaluated for adhesion by the 180° peel method according to JIS Z 0237.

(iii) Cohesion Between the Barrier Layer and the Release Layer

The surface of the release layer each of the heat-sensitive recording adhesive sheets obtained as above was rubbed with a fingertip to visually assess the cohesion between the barrier layer and the release layer.

Evaluation

A: The surface of the release layer was not peeled off and there was no cloudiness found.

B: The surface of the release layer was not peeled off but there was cloudiness to some extent.

C: The surface of the release layer was not peeled off but there was cloudiness to a great extent.

D: The surface of the release layer was peeled off.

(iv) Amount of Residual Substances Adhered to the Thermal Printing Head

After carrying out the recording in the test described in item (i) "Color forming property" above, the amount of residual substances that adhered to the thermal head was evaluated according to the following criteria.

Evaluation

A: No residual substance was observed on the head.

B: A negligible amount of residual substance was observed on the head.

C: A small amount of residual substance was observed on the head.

D: A substantial amount of residual substance was observed on the head.

(v) Optical Surface Roughness

With use of Microtopograph (manufactured by Toyo Seiki Seisakusho), optical surface roughness (Rp value) was measured under the conditions of 20 kgf/cm$^2$.

(vi) Stability of a Coating Composition for Forming the Barrier Layer

The coating compositions for forming the barrier layer used in Examples 1 and 11 were evaluated for viscosity change by measuring their viscosity (mPa.s) at 20° C., 1 hour and 72 hours after the preparation thereof, by means of a Brookfield viscometer.

TABLE 1

| | 1 hour after preparation | 72 hours after preparation |
|---|---|---|
| Coating composition for forming the barrier layer used in Example 1 | 85 | 90 |
| Coating composition for forming the barrier layer used in Example 11 | 90 | 430 |

TABLE 2

| | Color forming property | Adhesion between Release Layer and Adhesive Layer (g/cm) | Adhesion between Barrier Layer and Release | Amount of Residual Substances | Optical Surface Roughness (μm) |
|---|---|---|---|---|---|
| Example 1 | 2.10 | 1 | A | A | 0.28 |
| Example 2 | 2.09 | 1 | A | A | 0.52 |
| Example 3 | 2.01 | 1 | A | A | 1.16 |
| Example 4 | 1.95 | 1 | A | A | 1.05 |
| Example 5 | 1.97 | 1 | A | A | 1.24 |
| Example 6 | 2.01 | 1 | A | A | 0.89 |
| Example 7 | 2.05 | 2 | A | A | 0.30 |
| Example 8 | 2.13 | 1 | B | A | 0.12 |
| Example 9 | 2.18 | 1 | B | B | 0.10 |
| Example 10 | 1.92 | 3 | A | A | 0.34 |
| Example 11 | 2.10 | 1 | A | A | 0.28 |
| Example 12 | 1.97 | 1 | A | A | 0.28 |

TABLE 2-continued

| | Color forming property | Adhesion between Release Layer and Adhesive Layer (g/cm) | Adhesion between Barrier Layer and Release | Amount of Residual Substances | Optical Surface Roughness (μm) |
|---|---|---|---|---|---|
| Example 13 | 2.15 | 1 | A | A | 0.28 |
| Example 14 | 2.06 | 1 | A | A | 0.28 |
| Comparison Example 1 | 1.73 | 12 | D | C | 2.47 |
| Comparison Example 2 | 2.15 | 1 | D | D | 0.08 |
| Comparison Example 3 | 1.56 | 35 | C | C | 3.13 |
| Comparison Example 4 | 2.03 | 2 | D | C | 0.64 |

As seen from the results in Table 2, the heat-sensitive recording adhesive sheets according to the present invention give excellent results in the test for color forming property and therefore are excellent in recording sensitivity. The results also show that the heat-sensitive recording adhesive sheets according to the present invention are excellent in cohesion between the barrier layer and the release layer. The heat-sensitive recording adhesive sheets according to the present invention are also excellent in printer runability.

We claim:

1. A liner free heat-sensitive recording adhesive sheet comprising a substrate, a heat-sensitive recording layer formed on one face of the substrate, a barrier layer formed on the heat-sensitive recording layer, a release layer formed on the barrier layer, and an adhesive layer formed on the other face of the substrate, wherein the barrier layer is formed from a coating composition comprising colloidal silica and at least one member selected from the group consisting of water-soluble resins and water-dispersible resins.

2. The liner free heat-sensitive recording adhesive sheet according to claim 1 wherein the colloidal silica is present in an amount of 5 to 60% by weight, calculated as solids, based on the total solids of the barrier layer.

3. The liner free heat-sensitive recording adhesive sheet according to claim 1 wherein the colloidal silica has a pH of 5 to 11 and contains residual sodium oxide in an amount of 0.5% by weight or less.

4. The liner free heat-sensitive recording adhesive sheet according to claim 1 wherein said at least one member selected from water-soluble resins is an acetoacetyl-modified polyvinyl alcohol, casein or a copolymer mainly comprising styrene and an ethylenically unsaturated carboxylic acid salt.

5. The liner free heat-sensitive recording adhesive sheet according to claim 1 wherein said at least one member selected from the group consisting of water-soluble resins and water-dispersible resins is an acetoacetyl-modified polyvinyl alcohol.

6. The liner free heat-sensitive recording adhesive sheet according to claim 1 wherein said at least one member selected from the group consisting of water-soluble resins and water-dispersible resins is a copolymer mainly comprising styrene and an ethylenically unsaturated carboxylic acid salt.

7. The liner free heat-sensitive recording adhesive sheet according to claim 6 wherein the copolymer mainly comprising styrene and an ethylenically unsaturated carboxylic acid salt has an acid value of 40 to 80 mg KOH/g resin.

8. The liner free heat-sensitive recording adhesive sheet according to claim 1 wherein said at least one member selected from the group consisting of water-soluble resins and water-dispersible resins is present in an amount of 30 to 95% by weight based on the total solids of the barrier layer.

9. The liner free heat-sensitive recording adhesive sheet according to claim 1 wherein the barrier layer further contains a water-resisting agent.

10. The liner free heat-sensitive recording adhesive sheet according to claim 1 which further comprises an intermediate layer mainly comprising at least one member selected from the group consisting of water-soluble resins and water-dispersible resins between the heat-sensitive recording layer and the barrier layer.

11. The liner free heat-sensitive recording adhesive sheet according to claim 10 wherein said at least one member selected from the group consisting of water-soluble resins and water-dispersible resins is an acetoacetyl-modified polyvinyl alcohol, casein or a copolymer mainly comprising styrene and an ethylenically unsaturated carboxylic acid salt.

12. The liner free heat-sensitive recording adhesive sheet according to claim 10 wherein said at least one member selected from the group consisting of water-soluble resins and water-dispersible resins is a copolymer mainly comprising styrene and an ethylenically unsaturated carboxylic acid salt.

13. The liner free heat-sensitive recording adhesive sheet according to claim 12 wherein the copolymer mainly comprising styrene and an ethylenically unsaturated carboxylic acid salt has an acid value of 40 to 80 mg KOH/g resin.

14. The liner free heat-sensitive recording adhesive sheet according to claim 10 wherein the intermediate layer further contains a water-resisting agent.

15. The liner free heat-sensitive recording adhesive sheet according to claim 1 wherein the heat-sensitive recording layer further contains a water-resisting agent.

16. The liner free heat-sensitive recording adhesive sheet according to claim 1 wherein the heat-sensitive recording layer contains 4-hydroxy-4'-isopropoxydiphenylsulfone or 3,3'-diallyl-4,4'-dihydroxydiphenylsulfone as a color developing agent.

17. The liner free heat-sensitive recording adhesive sheet according to claim 1 wherein the heat-sensitive recording layer contains 1,1-bis(4-hydroxyphenyl)-1-phenylethane, zinc 4-[2-(p-methoxyphenoxy)ethyloxy]salicylate, zinc 4-[3-(p-tolylsulfonyl)propyloxy]salicylate, zinc 5-[p-(2-p-methoxyphenoxyethoxy)cumyl]salicylate or zinc 4-n-octyloxycarbonylamino salicylate as a color developing agent.

18. The liner free heat-sensitive recording adhesive sheet according to claim 1 wherein the release layer surface has an optical surface roughness (Rp value) of 0.1 to 2.0 $\mu$m.

19. The liner free heat-sensitive recording adhesive sheet according to claim 1 which further comprises an undercoat layer between the substrate and the heat-sensitive recording layer, the undercoat layer comprising a resin and an inorganic pigment or a hollow organic pigment having an oil absorption of 80–300 ml/100 g as determined according to JIS K 5101.

* * * * *